US008151979B2

(12) United States Patent
Lindenmayer

(10) Patent No.: US 8,151,979 B2
(45) **Date of Patent: *Apr. 10, 2012**

(54) BOTTLE BOX PACKAGE

(76) Inventor: David O. Lindenmayer, Marysville, IN (US)

( * ) Notice: Subject to any disclaimer, the term of this patent is extended or adjusted under 35 U.S.C. 154(b) by 110 days.

This patent is subject to a terminal disclaimer.

(21) Appl. No.: 12/380,509

(22) Filed: Feb. 27, 2009

(65) Prior Publication Data

US 2010/0176188 A1 Jul. 15, 2010

(51) Int. Cl.
*A45C 13/10* (2006.01)
*A45C 13/18* (2006.01)

(52) U.S. Cl. ..... 206/1.5; 70/63; 312/218

(58) Field of Classification Search ..... 206/525, 206/1.5, 298, 775–783; 312/216–217, 107, 312/107.5, 218; 220/243, 250; 217/36, 69, 217/71; 70/14, 58, 163–164, 63
See application file for complete search history.

(56) References Cited

U.S. PATENT DOCUMENTS 778,876 A * 1/1905 Matteson ..... 217/36
1,446,100 A * 2/1923 Morris ..... 217/7
2,700,457 A * 1/1955 Munroe ..... 206/320
2,835,381 A * 5/1958 Ackermann et al. ..... 206/3
3,809,417 A * 5/1974 Craig ..... 292/259 R
6,755,053 B1 * 6/2004 Dias ..... 70/14

OTHER PUBLICATIONS

Woodford Reserve at SpirtsAndCocktails.com, picture and drink by Jamie Boudreu, printed Jan. 7, 2009, shows bottle box by David Lindenmayer.

* cited by examiner

*Primary Examiner* — Mickey Yu
*Assistant Examiner* — Chun Cheung
(74) *Attorney, Agent, or Firm* — Carrithers Law Office PLLC

(57) ABSTRACT

A package for shipping and displaying bottles of beverage vertically upright. A rectangular box is provided for receiving and holding a bottle therein. The box is formed from a top and bottom panels connecting to side panels and front and back support members at the top and bottom of the box. An additional longitudinal member extending along the top at the rear of the box supports the bottle neck with a moveable bar or rod extending across the body of the bottle through a hole in the side panel abutting and engaging a slot or depression formed in the opposing side panel. A retaining means such as a peg or lock secures the rod from moving.

6 Claims, 4 Drawing Sheets

BOTTLE BOX PACKAGE

FIELD OF INVENTION

This invention relates in general to a decorative bottle box package for transporting, storage, and display of beverages.

BACKGROUND OF INVENTION

Conventional boxes which are used to package bottles such as wine or liquor typically include a portion is in the shape of an oblong box having an open side into which a bottle to be packaged is placed and the corresponding portion is in the form of a case into which the first portion may be designed to seal the open side of the first portion.

In conventional use, upon opening a bottle packaging box enclosing a bottle, e.g., containing a quality of wine, the bottle is removed from the box and the box is then discarded. The unpackaged bottle is then placed on a shelf for sale.

The wine or liquor is placed in a package for shipment, generally in a paper or corrugated box. The bottles are positioned vertically. Within the box, each bottle needs to be supported at its bottom end spaced from the bottom of the box in a position which secures the bottle against movement laterally. The upper end of each bottle also needs to be held so that movement is prevented. In a case, the bottle packages have to be secured against moving relative to each other and against movement relative to the box in which they are positioned.

SUMMARY OF INVENTION

In keeping with the foregoing object there is provided in accordance with one aspect of the present invention provides a bottle box defining a base panel, a lid, a first side panel and a second side panel connecting to the base panel and the lid, a top rear longitudinal member extending between the first side panel and the second side panel and extending below the lid, and a bottom rear longitudinal member extending between the first side panel and the second side and extending above the base. At least one of the first side panel and the second side panel includes a first bore hole at a selected position along the front of the first side panel and the second side panel, and the opposing side panel including a holding means comprising a depression, bore, or slot corresponding to and in alignment with the first bore hole. A longitudinal member extends through the first bore hole between the first side panel and the second side panel and having a distal end disposed into the second holding means. A retaining means extends through the first bore hole of the rod limiting lateral movement of the rod retaining a bottle in the box.

The present invention relates to improved packaging, containers and boxes, for objects, such as bottles or similarly shaped articles, and is particularly directed to a novel and unique container for a bottle which is adapted to function as a package for the bottle during shipping, storage and handling in addition serving as a decorative display box for holding the bottle on the shelf. The box is designed to have an open front and back to display the brand of the bottle and contents therein. While a preferred embodiment utilizes solid side panels it is contemplated that portions of the side panels could also be cut away to dispose the contents of the bottle so long as the side walls provide adequate support and cushioning to securely support the bottle.

It is an object of the present invention to provide a vertical bottle box having an open front and rear panel to display the label of the bottle product.

It is another object of the present invention to provide a box having side panels connecting to a top and bottom or base panel and a bottom or base longitudinal strip of material connecting the side panels to the base with a top longitudinal strip in order to provide a clear view of the front and rear of the bottle.

It is another object of the present invention to provide a inexpensive means to secure the top of the bottle from moving backward by including a step or lip extending internally and running longitudinally parallel to the rear top longitudinal strip.

It is another object of the present invention to provide a bar or rod extending across the mid section of the bottle to bias the top of the bottle against the rear top strip and the bottom of the bottle against the rear base strip.

It is another object of the present invention to provide a retaining means cooperatively engaging the bar or rod wherein the rod extends through a front portion of at least one side of a first side panel to a depression, slot or hole extending at least part of the way through the interior surface of the opposing side panel.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF PREFERRED EMBODIMENT

Figure 1:
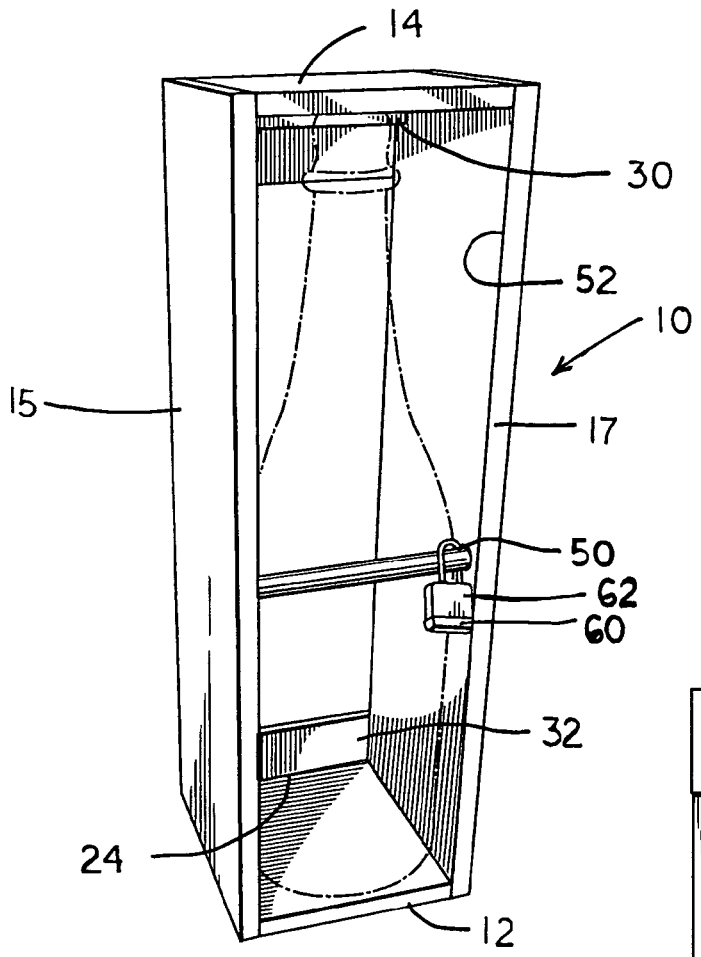
FIG. 1 is a perspective view of the bottle box package showing a bar and padlock holding a phantom bottle in position therein.
Figure 2:
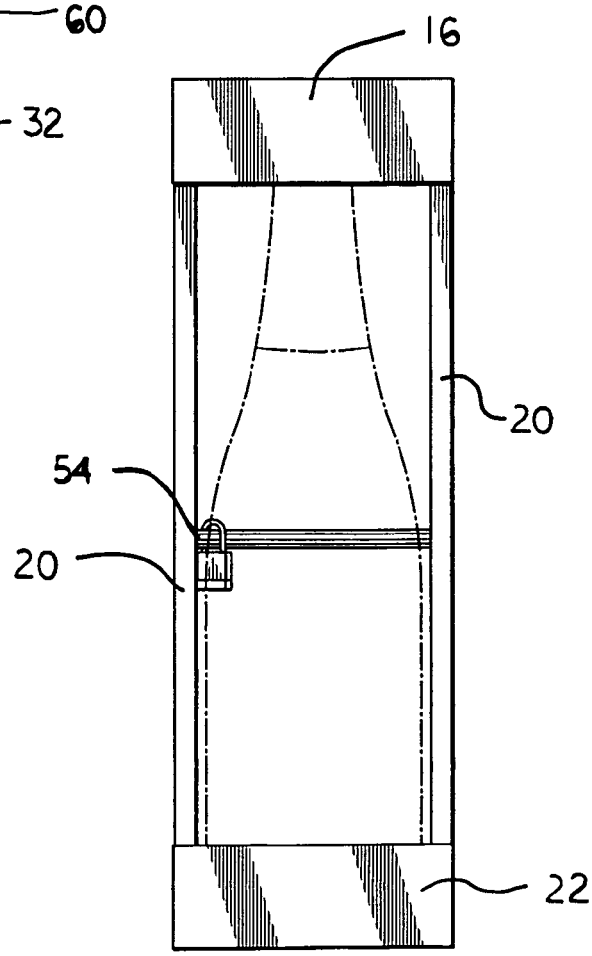
FIG. 2 is a front view of the bottle box package of FIG. 1.
Figure 3:
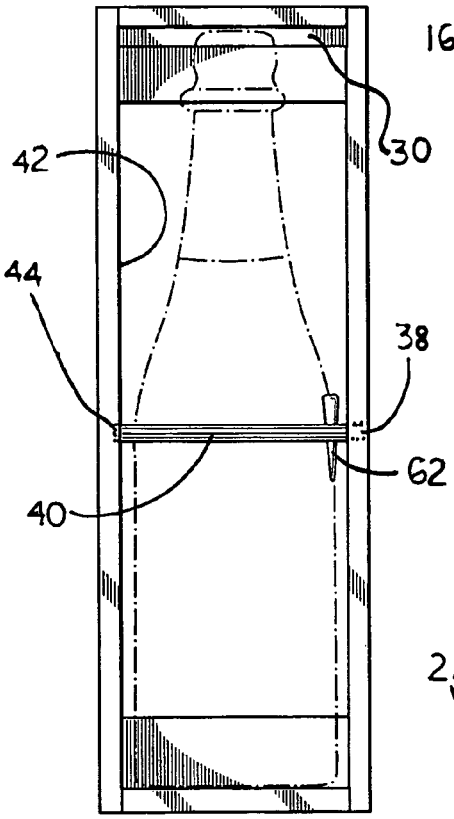
FIG. 3 is a rear plan view of the bottle box package of FIG. 1.
Figure 4:
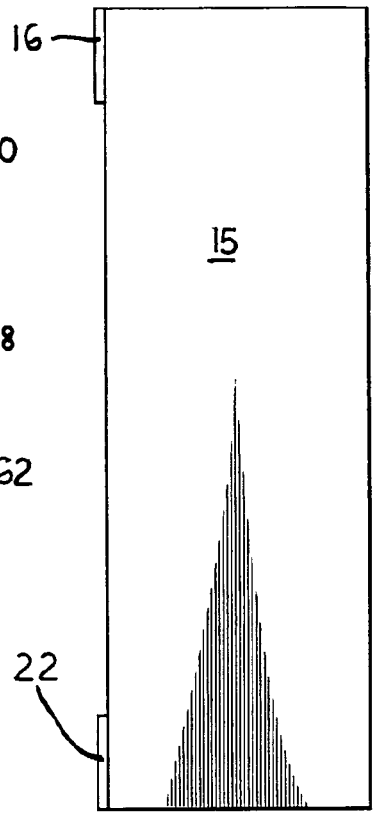
FIG. 4 is a left side view of the bottle box package of FIG. 1.
Figure 5:
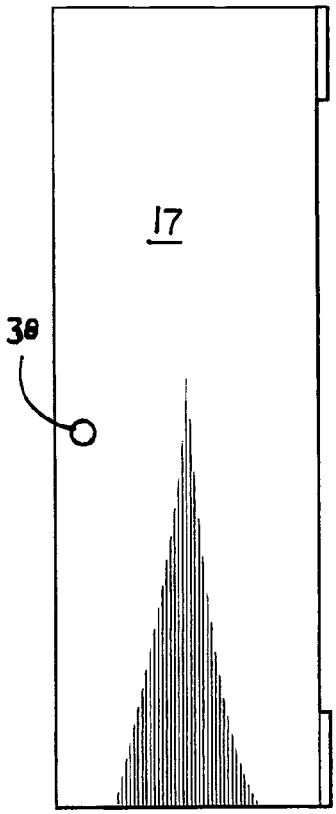
FIG. 5 is a right side view of the bottle box package of FIG. 1.
Figure 6:
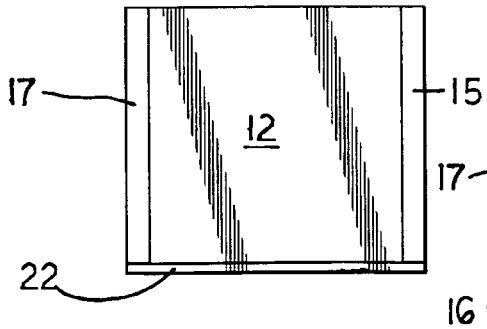
FIG. 6 is a bottom view of the bottle box package of FIG. 1.
Figure 7:
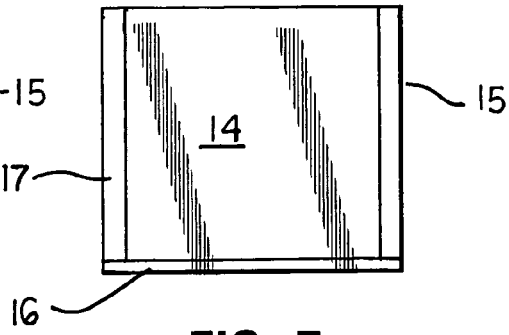
FIG. 7 is a top view of the bottle box package of FIG. 1.

FIGS. 1-8 and 10 illustrate a preferred embodiment for the instant single bottle box package 10. The preferred embodiment is made of wood, of course it is contemplated that the container could be molded from a polymer or a combination of wood and plastic or even fiberglass.

As shown in one preferred embodiment individual panels are connected together by holding means such as staples, nails, glue, cord, thread, or combinations thereof. The box 10 comprises a solid bottom base panel 12 and a solid top panel or lid 14 connected together by solid rectangular side panels, wherein the left side panel is designated as a first side panel 15 and the right side panel is designated as the second side panel 17 which are stapled to the exterior surface of the lid 14 and the base 12 forming a self supporting rectangular box.

A first longitudinal strip 16 of material is affixed to the rear side surface 18 of the lid 14 and connecting to the rear edges 20 of the first side panel 15 and second side panel 17 whereby it extends downwardly a selected distance pass the lid 14 to form an upper rear holding member. A second longitudinal strip 22 of material is affixed to the rear side surface 24 of the base 12 and connecting to the rear edges 20 of the first side panel 15 and the second side panel 17 where it projects upwardly pass the base 12 to form a base rear holding member.

A longitudinal positioning bar or strip of material 30 is sized to extend between the first side panel 15 and second side panel 17 and abut the bottom surface 26 of the lid and the interior surface 28 of the first longitudinal strip 16 extending along the top and rear of the box 10. The bar 30 is sized at a thickness to extend inwardly to touch the top of a bottle disposed within the box 10 and limit rearward movement of the top of the bottle. The bottom of the bottle abuts the interior surface 32 of the second longitudinal strip 22 extending along the rear portion of the base 10.

The bottle is retained within the box 10 by a gate means comprising a bore hole 38 formed in the front middle portion of one of the side panels, for example the second side panel 17 wherein a rod 40 is inserted there through extending to the interior surface 42 of the opposing side panel 15 and extends across the front of the box 10 where it is inserted into a depression or bore 44 which extends only a selected distance into the side panel 15 and rests thereon. The rod 40 includes a retaining means comprising a hole 50 drilled normal thereto at a selected distance from the interior surface 52 of the second panel 17, and a pin means such as lock or peg inserted into the hole 50 in the rod 40 abutting the interior surface 42 of the side wall 17 to restrict the rod 40 from moving backward and securing the distal end of the rod 54 resting in the depression 44 preventing lateral movement thereof. In one preferred embodiment a resilient cushioning means 62 such as a pad, rubber band 60, O-ring, or other soft cushioning material circumvents the padlock 62 preventing damage to the bottle therein and providing a fanciful retaining means.

Figure 8:
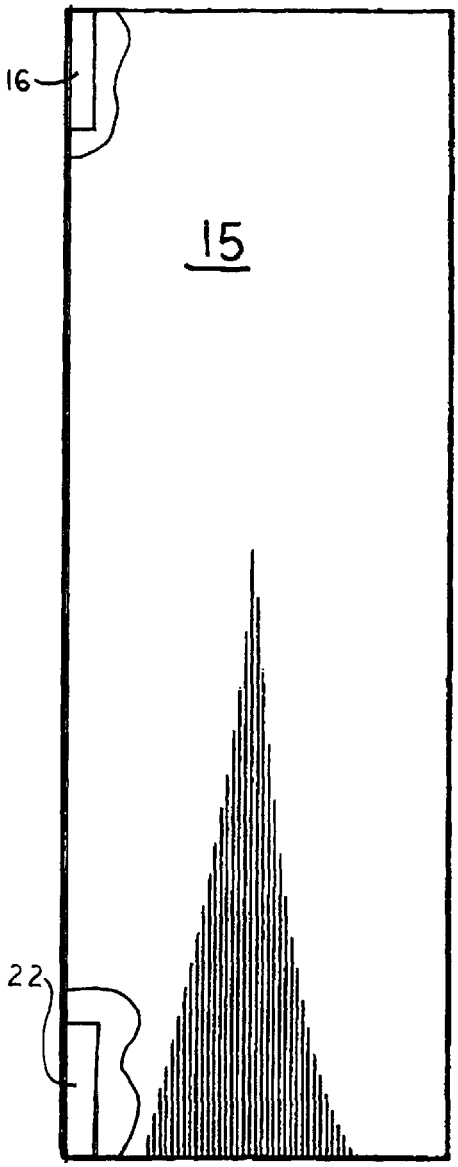
FIG. 8 is a left side view of an alternate embodiment of a bottle box package showing the rear longitudinal members inserted between the panels providing a flush fit with the rear edge of said panels.
Figure 9:
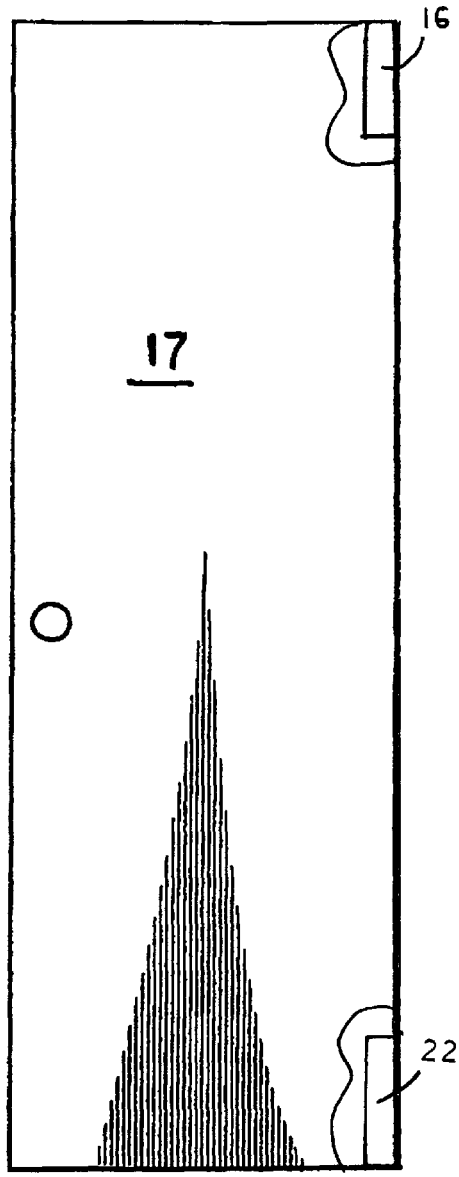
FIG. 9 is a right side view of the embodiment of a bottle box package of FIG. 8.

FIGS. 8-9 show an alternate embodiment wherein a first longitudinal strip 16 of material which is cut or formed by molding or the like to fit between the interior surface 52 of the panels 15, 17 adjacent the rear side surface 18 of the lid 14 and connecting to the inner surface of the rear edges 20 of the first side panel 15 and second side panel 17 whereby it extends downwardly a selected distance pass the lid 14 to form an insertable upper rear holding member. A second longitudinal strip 22 of material which is cut or formed by molding or the like is affixed to the interior surface 52 of the rear side surface of the base 12 and connecting to the inner surface of the rear edges 20 of the first side panel 15 and the second side panel 17 where it projects upwardly pass the base 12 to form an insertable base rear holding member providing a uniform smooth rear exterior box surface for mounting or stacking.

Figure 10:
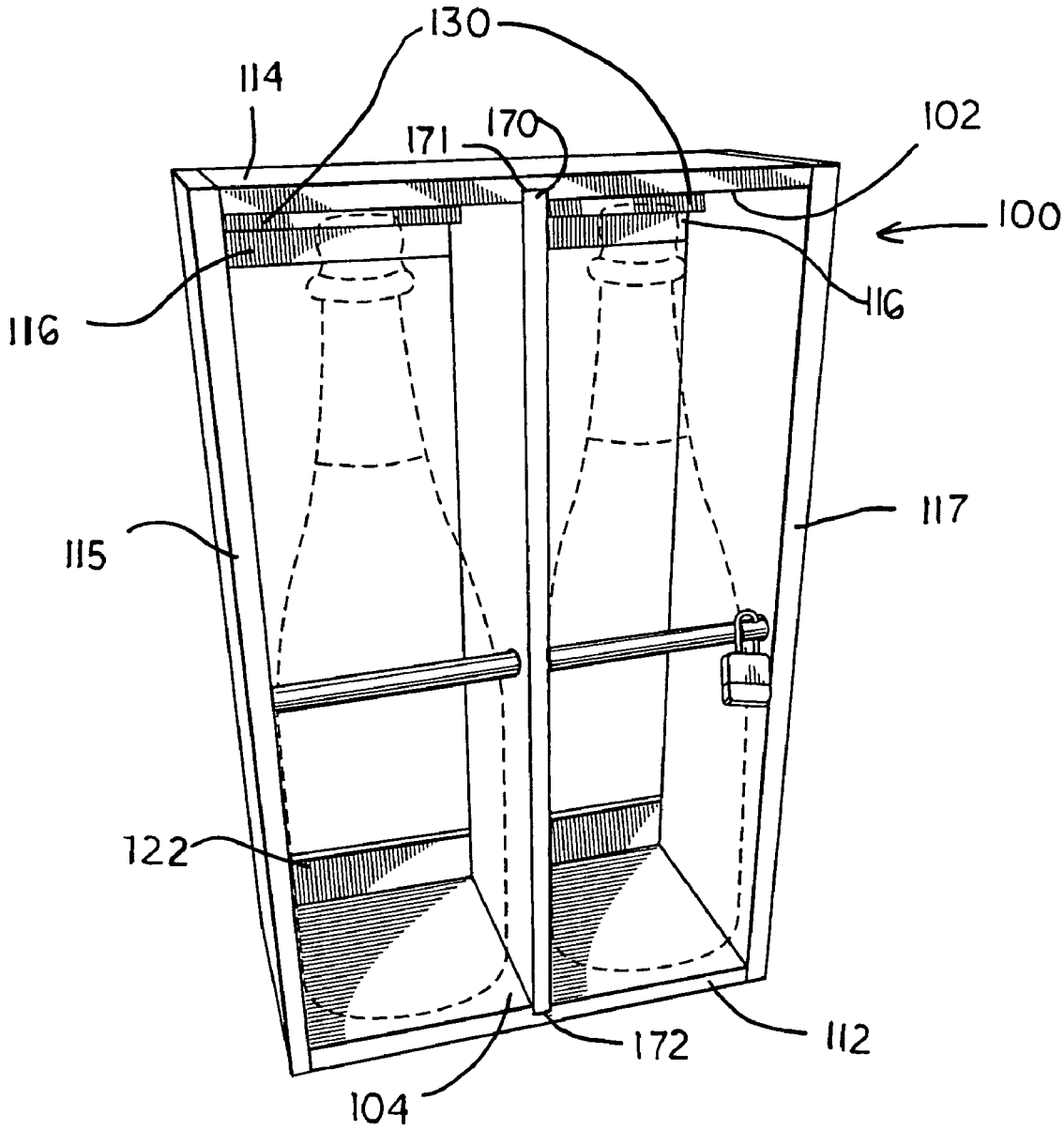
FIG. 10 is an alternate embodiment showing a twin pack of the present invention.

As shown in FIG. 10, an alternate embodiment dual bottle box 100 uses an additional center panel 170 inserted into a top dado groove 171 and bottom dado groove 172 formed in the bottom surface 102 of the lid 114 and the top surface 104 of the base 112 medially positioned and parallel to the first side panel 115 and second side panel 117 for use in a twin pack box 100 of an alternate embodiment in order to two or more bottles within the same package. The lid 114, base 112, bar 130, first longitudinal strip 116 and second longitudinal strip 122 extend all the way across the width of the dual bottle box 100.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

I claim:

1. A bottle box, comprising:

a base;

a lid;

a first side panel and a second opposing side panel connecting to said base and said lid;

a top rear longitudinal member extending between said first side panel and said second side panel and extending below said lid;

a bottom rear longitudinal member extending between said first side panel and said second side panel and extending above said base adjacent a bottom portion of a bottle limiting rearward movement thereof;

a positioning means disposed between said first side panel and said second side panel cooperatively abutting and limiting rearward movement of a top portion of a neck of said bottle;

wherein said positioning means comprises a positioning bar extending from a bottom surface of said lid between said first side panel and said second side panel projecting downwardly and inwardly at a selected position for abutting and limiting rearward movement of a top portion of a neck of said bottle;

said first side panel having formed therein socket means and said second side panel having formed therein a first bore hole at a selected position and in alignment with said socket means;

a gate means for abutting a front body portion of said bottle, said gate means comprising a first longitudinal member extending through said first bore hole between said first side panel and said second side panel and having a distal end disposed into said socket means, said first longitudinal member having formed therein a transverse bore hole; and retaining means extending through said transverse bore hole in said first longitudinal member for abutting a surface of said second side panel for limiting lateral movement of said first longitudinal member within said box.

2. The bottle box of claim 1 wherein said retaining means extending through a second bore hole comprises a pad lock.

3. The bottle box of claim 1 wherein said retaining means extending through a second bore hole comprises a peg.

4. The bottle box of claim 1, wherein said transverse bore hole and said retaining means are positioned adjacent an interior surface of said second side panel.

5. A bottle box comprising:

a base;

a lid;

a first side panel and a second opposing side panel connecting to said base and said lid;

a center panel disposed between a first said panel and a second opposing side panel connecting to said base and said lid;

said top rear longitudinal member extending between said first side panel, said center panel, and said second side panel below said lid;

a bottom rear longitudinal member extending between said first side panel, said center panel, and said second side panel above said base for limiting rearward movement of a bottom portion of a bottle;

a positioning means disposed between said first side panel and said center panel, and said center panel and said second side panel cooperatively abutting and limiting rearward movement of a top portion of a neck of said bottle;

wherein said positioning means comprises a positioning bar extending from a bottom surface of said lid between said first side panel and said center panel, and between said center panel and said second side panel projecting downwardly and inwardly at a selected position for abutting and limiting rearward movement of a top portion of a neck of said bottle;

a selected one of said first side panel and said second side panel having formed therein socket means, and said center panel and a selected one of said first side panel and said second side panel having formed therein a through bore hole at a selected position and in alignment with said socket means disposed in said opposing said panel;

a gate means for abutting a front body portion of said bottle, said gate means comprising a first longitudinal member extending through said bore hole of a selected one of said first side panel or said second side panel and said center panel and said first longitudinal member having a distal end disposed into said socket means, said first longitudinal member having formed therein a transverse bore hole at a selected position; and a retaining means extending through said transverse bore hole in said first longitudinal member for abutting a surface of said first side panel or said second side panel or said center panel for limiting lateral movement of said fourth longitudinal member within said box.

6. The bottle box of claim 1, wherein said transverse bore hole and said retaining means are positioned adjacent an interior surface of said second side panel or said first side panel.

* * * * *